US010069249B2

(12) United States Patent
Dai

(10) Patent No.: US 10,069,249 B2
(45) Date of Patent: Sep. 4, 2018

(54) CABLE APPARATUS

(71) Applicant: LOTES CO., LTD, Keelung (TW)

(72) Inventor: Yong Jun Dai, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/818,904

(22) Filed: Nov. 21, 2017

(65) Prior Publication Data

US 2018/0175558 A1 Jun. 21, 2018

(30) Foreign Application Priority Data

Dec. 19, 2016 (CN) ..... 201621390583.4

(51) Int. Cl.

| | |
|---|---|
| ***H01R 13/6589*** | (2011.01) |
| ***H01R 13/6582*** | (2011.01) |
| ***H01R 24/60*** | (2011.01) |
| ***H01R 24/30*** | (2011.01) |
| *H01R 107/00* | (2006.01) |

(52) U.S. Cl.

CPC ..... *H01R 13/6589* (2013.01); *H01R 13/6582* (2013.01); *H01R 24/30* (2013.01); *H01R 24/60* (2013.01); *H01R 2107/00* (2013.01)

(58) Field of Classification Search

CPC .... H01R 12/721; H01R 13/20; H01R 13/629; H01R 12/709; H01R 13/6581

USPC ..... 439/607.08

See application file for complete search history.

(56) References Cited

U.S. PATENT DOCUMENTS

| | | | | |
|---|---|---|---|---|
| 5,238,411 A * | 8/1993 | Jinno | ..... | H01R 12/721 439/59 |
| 6,652,322 B2 * | 11/2003 | Ito | ..... | H01R 12/721 439/637 |
| 7,198,525 B2 * | 4/2007 | Nagamine | ..... | H01R 12/721 439/843 |
| 7,402,089 B1 * | 7/2008 | Myer | ..... | H01R 13/11 439/877 |
| 7,470,160 B1 * | 12/2008 | Mostoller | ..... | H01R 12/721 439/856 |

(Continued)

FOREIGN PATENT DOCUMENTS

| | | |
|---|---|---|
| CN | 2886982 Y | 4/2007 |
| CN | 204271349 U | 4/2015 |

(Continued)

*Primary Examiner* — Alexander Gilman

(74) *Attorney, Agent, or Firm* — Locke Lord LLP; Tim Tingkang Xia, Esq.

(57) ABSTRACT

A cable apparatus includes a circuit board having ground and signal pads, an insulating body in front of the circuit board, a pair of differential signal terminals retained in the insulating body, a cable located in front of the insulating body, and a shielding shell fixed to the insulating body. One ground pad is provided on each of two sides of adjacent two signal pads. Each terminal has an elastic portion extending out of the insulating body and conducting the signal pad, and a contacting portion exposed on a surface of the insulating body. The cable has two cable cores connected to the contacting portions, two insulation layers respectively wrapping the cable cores, and a shielding layer wrapping the insulation layers. The shielding shell has one end covering the contacting portions and conducting the shielding layer, and the other end covering the elastic portions and connected to the ground pads.

17 Claims, 7 Drawing Sheets

(56) References Cited

U.S. PATENT DOCUMENTS

| | | | | |
|---|---|---|---|---|
| 7,666,015 | B2 * | 2/2010 | Sakamoto | H01R 13/629 439/260 |
| 8,794,991 | B2 * | 8/2014 | Ngo | H01R 13/6273 439/350 |
| 8,834,190 | B2 * | 9/2014 | Ngo | H01R 12/7023 439/328 |
| 8,870,598 | B2 * | 10/2014 | Qi | H01R 13/6581 439/620.03 |
| 9,373,915 | B1 * | 6/2016 | Schulz | H01R 13/6594 |
| 9,401,563 | B2 * | 7/2016 | Simpson | H01R 13/5841 |
| 9,859,636 | B2 * | 1/2018 | Boyd | H01R 12/721 |
| 2006/0189195 | A1 * | 8/2006 | Okada | H01R 13/20 439/325 |

FOREIGN PATENT DOCUMENTS

| | | | |
|---|---|---|---|
| CN | 204809560 | U | 11/2015 |
| TW | 201228152 | A | 7/2012 |

* cited by examiner

A-A

CABLE APPARATUS

CROSS-REFERENCE TO RELATED APPLICATIONS

This non-provisional application claims priority to and benefit of, under 35 U.S.C. § 119(a), Patent Application No. 201621390583.4 filed in P.R. China on Dec. 19, 2016, the entire content of which is hereby incorporated by reference.

FIELD OF THE INVENTION

This invention relates to a cable apparatus, and more particularly to a high frequency cable apparatus that transmits high speed differential signals.

BACKGROUND OF THE INVENTION

Currently, cable signal transmission apparatuses are effective carriers of signal transmission of electronic device connectors. With the intelligentized development of electronic devices, processing capabilities of chips thereof also become stronger, and requirements for signal transmission rates of the cable signal transmission apparatuses are also higher. An existing cable for transmitting high frequency signals includes a conductor wrapped with an insulating body outside and a shield tape that wraps adjacent two of the insulation bodies at the same time. The conductor has a soldering portion exposed out of the shield tape, and is correspondingly soldered to a high speed differential pair terminal group of a connector, so that the conductor can transmit high speed signals of differential signal terminals. However, the soldering portion is exposed out of the shield tape, and consequently, the shield tape cannot shield crosstalk at the soldering portion. When high speed signals pass through the soldering portion, crosstalk between adjacent differential signal pairs is inevitably caused and transmission quality of the cable signals is reduced. As a result, the cable cannot provide capability of stable signal transmission at a higher speed, and a bottleneck of using the cable exists.

Therefore, a heretofore unaddressed need exists in the art to address the aforementioned deficiencies and inadequacies.

SUMMARY OF THE INVETION

In one aspect, the present invention relates to a cable apparatus that has good shield performance, avoids high frequency signal transmission crosstalk, and can transmit high frequency signals stably.

In certain embodiments, a cable apparatus includes a circuit board, an insulating body located in front of the circuit board, a pair of differential signal terminals retained in the insulating body, a cable located in front of the insulating body, and a shielding shell, fixed to the insulating body. The circuit board has multiple ground pads and signal pads. Each of the two sides of adjacent two of the signal pads is provided with one of the pads. One end of each of the differential signal terminals is provided with an elastic portion that extends out of the insulating body and conducts with the signal pad, and the other end of each of the differential signal terminals is provided with a contacting portion exposed on a surface of the insulating body. The cable has two cable cores, two insulating layers respectively wrapping the cable cores, and a shielding layer wrapping the two insulating layers. Each of the cable cores is correspondingly connected to one of the contacting portions. One end of the shielding shell is covered on the contacting portions and conducts with the shielding layer, and the other end of the shielding shell is covered on the elastic portions and is connected to the ground pads.

In certain embodiments, only two of the signal pads are provided between any two adjacent ground pads on a same surface of the circuit board.

In certain embodiments, the shielding shell has a top wall and two side walls formed by bending and extension of opposite two sides of the top wall. One end of the top wall is soldered to the shielding layer, and an edge of the other end bends and extends to form a rear wall. The rear wall is conductively connected to the ground pad. An edge of each of the side walls extends to form a shrapnel to urge against the ground pad.

In certain embodiments, a location where the shrapnel urges against the ground pad is a first contact location, a location where the elastic portion urges against the signal pad is a second contacting portion, and the first contact location and the second contact location are arranged in one row.

In certain embodiments, the shrapnel includes a connecting portion formed by backward extension from the side wall toward the circuit board, and a guiding portion formed by further extension toward a direction away from the circuit board. The guiding portion urges against the ground pad, and there is a gap between the guiding portion and the side wall.

In certain embodiments, an included angle between the guiding portion and the connecting portion is an obtuse angle to make the shrapnel hook-shaped.

In certain embodiments, the opposite two sides of the top wall further bend and extend to form two extending portions. The extending portions are located between the rear wall and the side walls. An edge of the extending portion is closer to the circuit board than the edge of the side wall, and does not contact the circuit board.

In certain embodiments, the extending portions are not connected to the rear wall.

In certain embodiments, the shielding layer is a copper foil, and longitudinally wraps the two insulation layers at the same time along a direction parallel to an axis of the cable core.

In certain embodiments, the ground pads are located on an upper surface and a lower surface of the circuit board. Each of the ground pads is connected to one of the shielding shells. Two of the ground pads aligned in a vertical direction are connected by means of at least two conductive paths, and the two conductive paths are located between two of the shielding shells.

In certain embodiments, at least one of the conductive paths directly faces a location where the shielding shell contacts the ground pad.

In certain embodiments, the shielding shell has two side walls. An edge of each of the side walls tears and extends to form a shrapnel to urge against the ground pad. One of the conductive paths directly faces a location where the shrapnel contacts the ground pad.

In certain embodiments, the insulating body includes a first body and a second body buckled with the first body. There are two rows of the differential signal terminals that are symmetrically arranged. The two rows of the differential signal terminals are separately integrally formed on the first body and the second body. The differential signal terminals in an upper row have the contacting portions exposed on a surface of the first body and soldered to the cable cores, and the differential signal terminals in a lower row have the contacting portions exposed on a surface of the second body and soldered to the cable cores.

In certain embodiments, two plastic blocks are respectively covered on the contacting portions in the upper row and the contacting portions in the lower row, and are integrally formed with the insulating body and the shielding shell.

In certain embodiments, the shielding shell is connected to the shielding layer by means of soldering.

In certain embodiments, two adjacent shielding shells and two pairs of the differential signal terminals are provided on a same surface of the circuit board. Each of the shielding shells is correspondingly covered on one pair of the differential signal terminals. Adjacent side walls of the two shielding shells are attached to each other and are connected to one of the ground pads.

In certain embodiments, two first slots and a second slot located between the two first slots are provided on the surface of the insulating body. A width of the second slot is greater than that of the first slot. The first slot correspondingly accommodates one side wall of the shielding shell. The second slot accommodates two side walls that are attached to each other of the two adjacent shielding shells at the same time.

Compared with the related art, certain embodiments of the present invention have the following beneficial advantages:

By means of the cable apparatus of this invention, the two cable cores are correspondingly soldered to one pair of the differential signal terminals; the shielding layer wraps the two cable cores; one end of the shielding shell is covered on the contacting portions and conducts with the shielding layer; and the other opposite end is covered on the elastic portions and is connected to the ground pad to form entire shielding coverage from front to back of the differential signal terminals and the cable cores, so as to ensure that an entire path of signal transmission has good electromagnetic shielding isolation, so that the cable apparatus can be adjusted to transmission of signals with higher rates.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
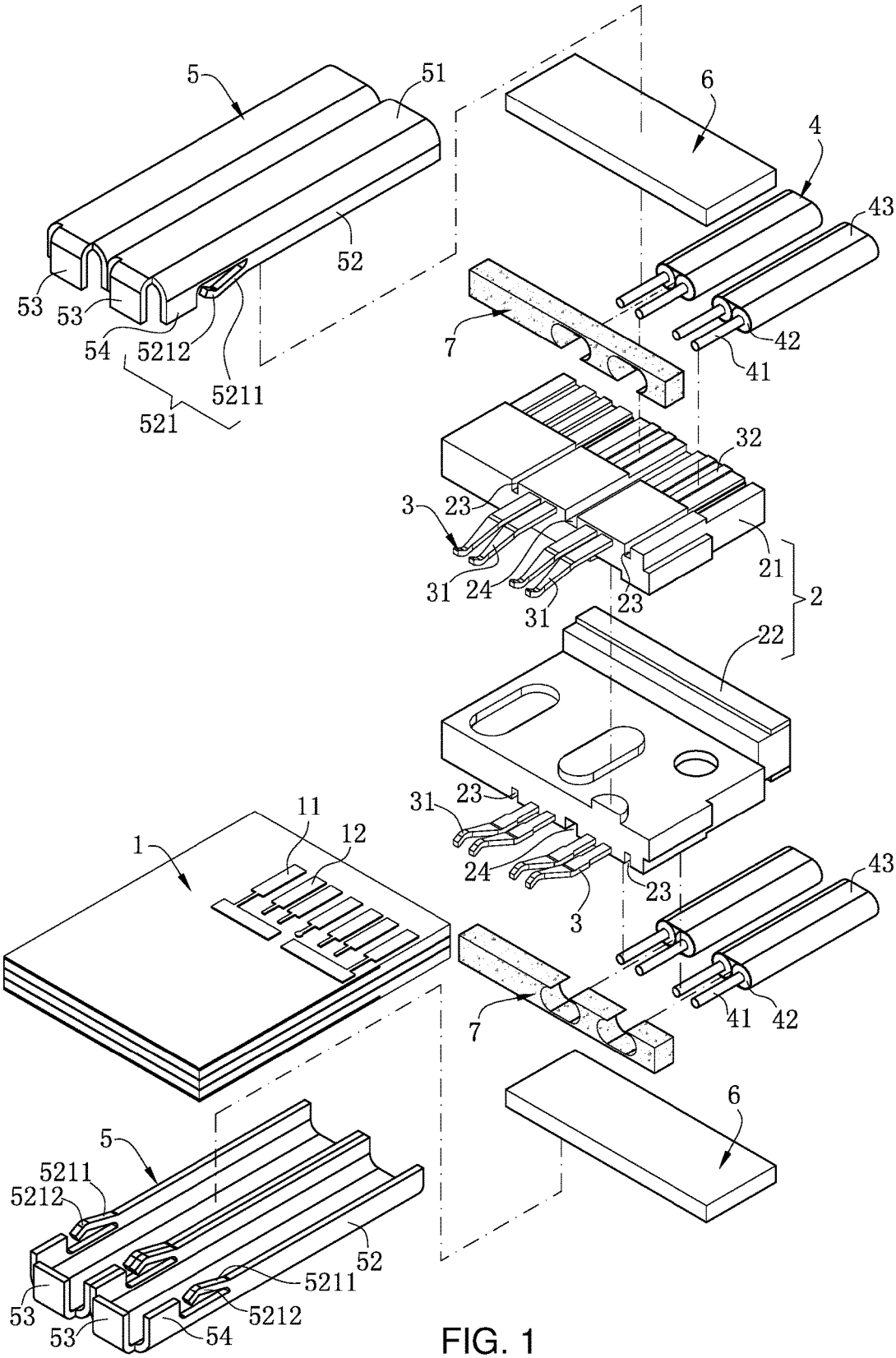
FIG. 1 is a three-dimensional exploded view of a cable apparatus according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-7. In accordance with the purposes of this invention, as embodied and broadly described herein, this invention, in one aspect, relates to a cable apparatus.

FIG. 1 shows a cable apparatus 100 according to one embodiment of the present invention. The cable apparatus 100 includes a circuit board 1, an insulating body 2, four pairs of differential signal terminals 3, four cables 4, four shielding shells 5, and two plastic blocks 6. The insulating body 2 is located in front of the circuit board 1. The four pairs of differential signal terminals 3 are symmetrically fixed to the insulating body 2 in two rows and partially exposed on upper and lower surfaces of the insulating body 2. Each of the cables 4 is correspondingly soldered to corresponding one pair of the differential signal terminals 3. Each of the shielding shells 5 is correspondingly covers on one pair of the differential signal terminals 3 and connected to the circuit board 1. The two plastic blocks 6 are correspondingly press and connect the two rows of the differential signal terminals 3.

Figure 2:
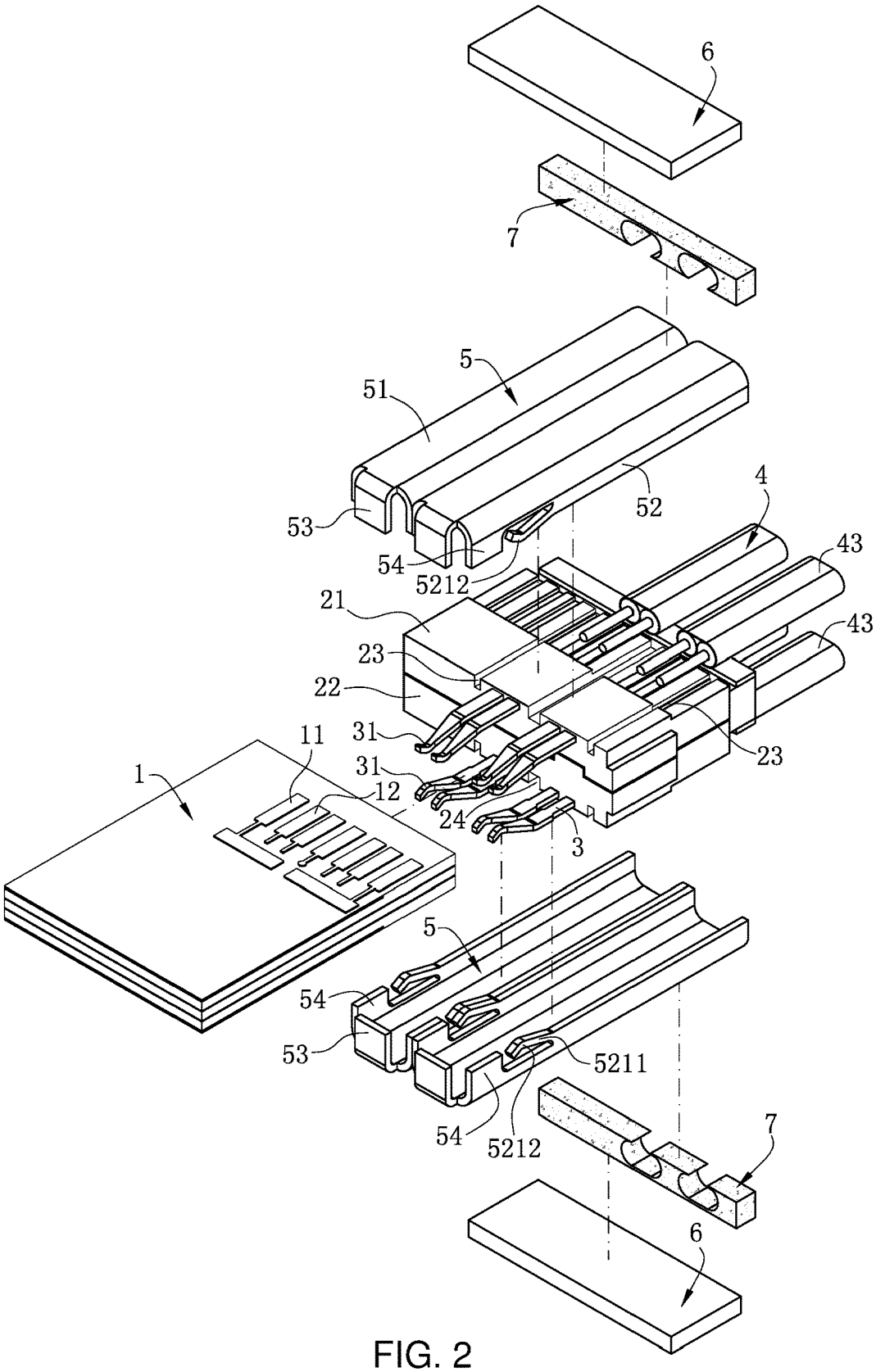
FIG. 2 is a three-dimensional partial exploded view of a cable apparatus according to one embodiment of the present invention.

As shown in FIGS. 1 and 2, each of the cables 4 includes two cable cores 41 and two insulation layers 42 that respectively wrap the two cable cores 41, and a shielding layer 43 that longitudinally wraps the two insulation layers 42 at the same time along a direction parallel to an axis of the cable core 41 to achieve electromagnetic shielding on crosstalk of signal transmission of the cable core 41. In this embodiment, the shielding layer 43 is a sheet-like copper foil. In other embodiments, the shielding layer 43 may be any other metal foil, as long as the shielding layer 43 can well shield crosstalk of the cable core 41, and this invention is not limited thereto.

Figure 3:
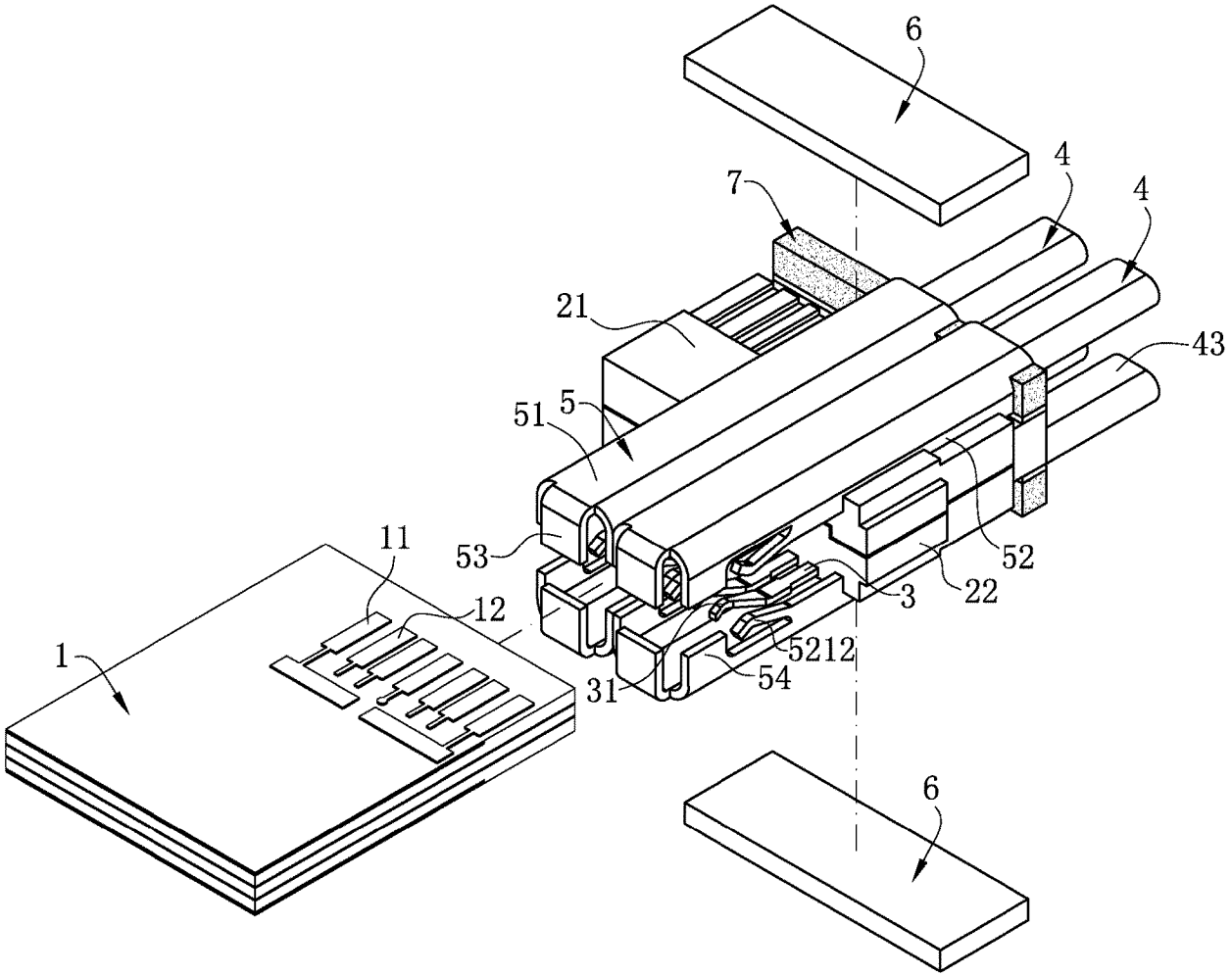
FIG. 3 is a three-dimensional view of a cable apparatus according to one embodiment of the present invention, where a shielding shell is soldered to shielding layers.
Figure 7:
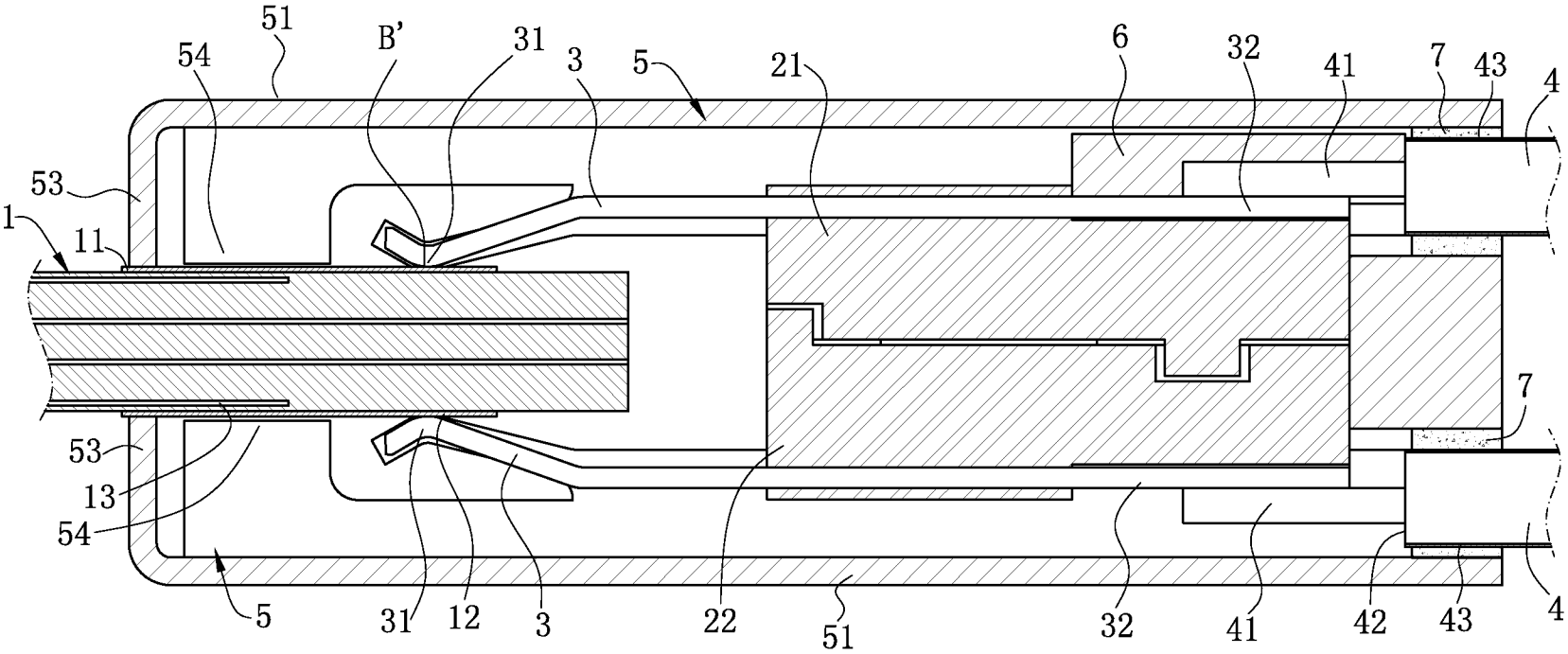
FIG. 7 is a sectional view along B-B after the plugging of a circuit board of a cable apparatus according to one embodiment of the present invention.

As shown in FIGS. 1, 3, and 7, the insulating body 2 includes a first body 21 and a second body 22 buckled with the first body 21 in a vertical direction. The first body 21 and the second body 22 both have two first slots 23 and a second slot 24 located between the two first slots 23. A width of the second slot 24 is greater than that of the first slot 23. The differential signal terminals 3 in an upper row are integrally formed with the first body 21. One end of each of the differential signal terminals 3 in the upper row is provided with an elastic portion 31 that extends out of the first body 21 to urge against an upper surface of the circuit board 1, and the other end is provided with a contacting portion 32 exposed on a surface of the first body 21 for being soldered to one of the cable cores 41. The differential signal terminals 3 in a lower row are integrally formed with the second body 22. One end of each of the differential signal terminals 3 in the lower row is provided with the elastic portion 31 that extends out of the second body 22 to urge against a lower surface of the circuit board 1, and the other end is provided with a contacting portion 32 exposed on a surface of the second body 22 for being soldered to one of the cable cores 41.

Figure 4:
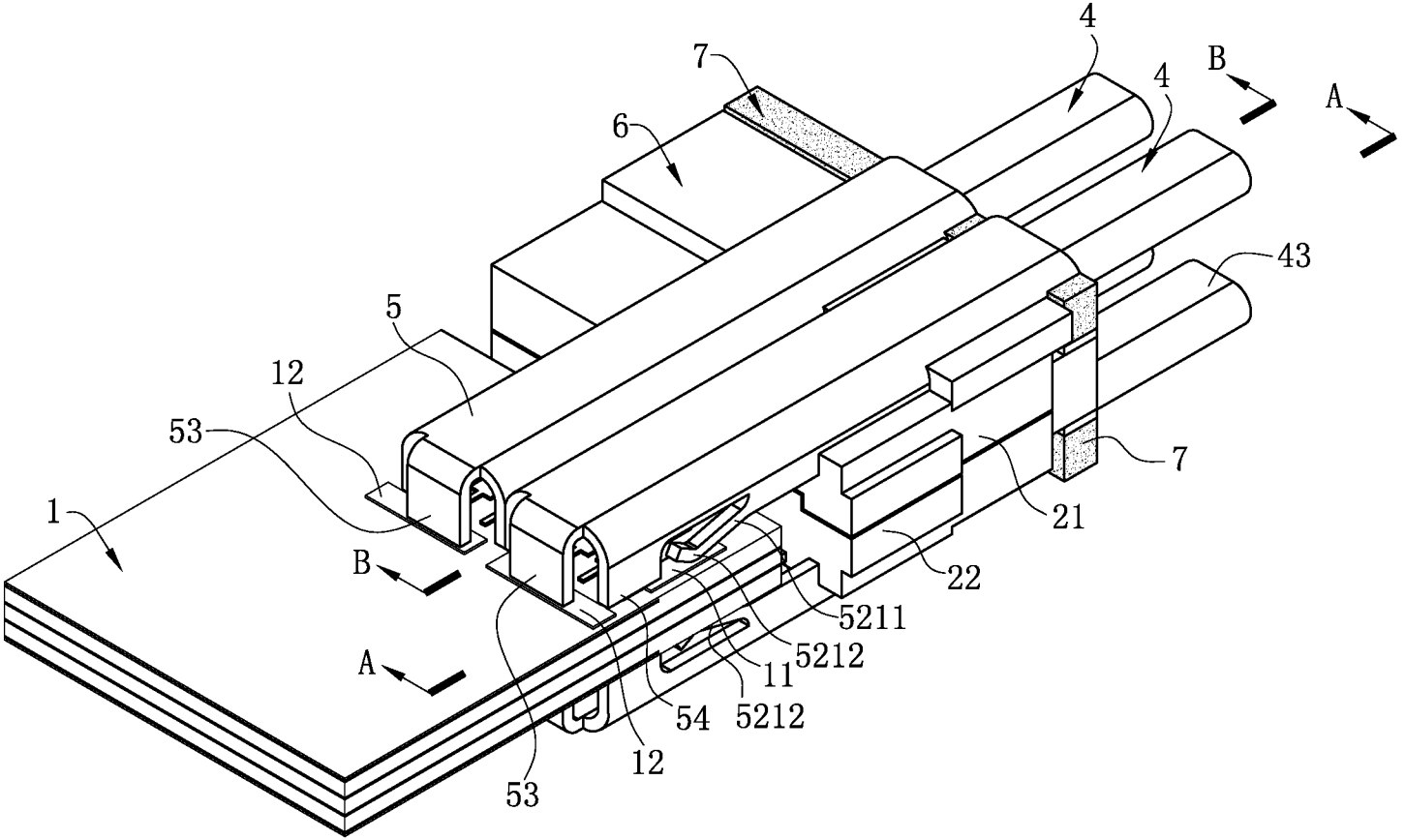
FIG. 4 is a three-dimensional assembly view of a cable apparatus according to one embodiment of the present invention.

As shown in FIGS. 2-4, adjacent two of the shielding shells 5 in each row are attached to each other and urge against a same pad on the circuit board 1 to save space of the circuit board 1. Each of the shielding shells 5 has a top wall 51 and two opposite side walls 52 formed by perpendicular bending and extending from opposite two sides of the top wall 51. A front end of the top wall 51 is covered on the contacting portions 32 and is soldered to the shielding layer 43 by means of a solder paste 7, so that a location where the cable core 41 is soldered to the corresponding contacting portion 32 is well shielded, and the shielding shell 5 and the shielding layer 43 continuously shield the signal transmission path without interruption. A rear end of the top wall 51 is covered on the elastic portions 31 and an edge thereof perpendicularly bends and extends to form a rear wall 53. The rear wall 53 conducts with the circuit board 1 to be grounded, so as to ensure an electromagnetic shielding effect of the shielding shell 5. In this embodiment, the rear wall 53 is not connected to the side wall 52, so that the rear wall 53 has elasticity of springing back and forth, so as to avoid rigid contact between the rear wall 53 and the circuit board 1, thereby improving stability of conduction therebetween.

As shown in FIGS. 1, 4, 6, and 7, the two adjacent side walls 52 are closely attached and are both accommodated in the second slot 24. An edge of each of the side walls 52 extends to form a shrapnel 521 to urge against the circuit board 1. A point where the shrapnel 521 urges against the circuit board 1 is a first contact location A', and a point where the elastic portion 31 urges against the circuit board 1 is a second contact location B'. The first contact location A' and the second contact location B' are arranged in one row, so as to ensure consistency of stress applied to pads on the circuit board 1. The shrapnel 521 includes a connecting portion 5211 formed by backward extension from the side wall 52 toward the circuit board 1, and a guiding portion 5212 formed by further extending toward a direction away from the circuit board 1. The guiding portion 5212 urges against the circuit board 1, so that multipoint conduction and grounding are formed between the shielding shell 5 and the circuit board 1, thereby enhancing a crosstalk isolation function of the shielding shell 5. An included angle between the guiding portion 5212 and the connecting portion 5211 is an obtuse angle, so that the guiding portion 5121 guides the circuit board 1 to be inserted between the differential signal terminals 3 in the upper row and the differential signal terminals 3 in the lower row, thereby preventing the connecting portion 5211 from scratching the pads on the circuit board 1. In addition, there is a gap between the guiding portion 5212 and the edge of the side wall 52 to enhance elasticity of the shrapnel 521, so that the side wall 52 stably and elastically urges against the circuit board 1, and resistance during plug connection of the circuit board 1 is also reduced. The opposite two sides of the top wall 51 further vertically extend to respectively form an extending portion 54, which is located between the rear wall 53 and the shrapnel 521, to increase a distance between the rear wall 53 and the shrapnel 521, so that elastic force of urging between the shielding shell 5 and the circuit board 1 is more uniform. Further, an edge of the extending portion 54 is closer to the circuit board 1 than the edge of the side wall 52, and a range of space, enclosed by the shielding shell 5, of the differential signal terminals 3 is increased. The extending portion 54 does not contact the circuit board 1, so as to avoid inconvenience of plug connection of the circuit board 1 due to excessively large force of urging between the shielding shell 5 and the circuit board 1.

Figure 5:
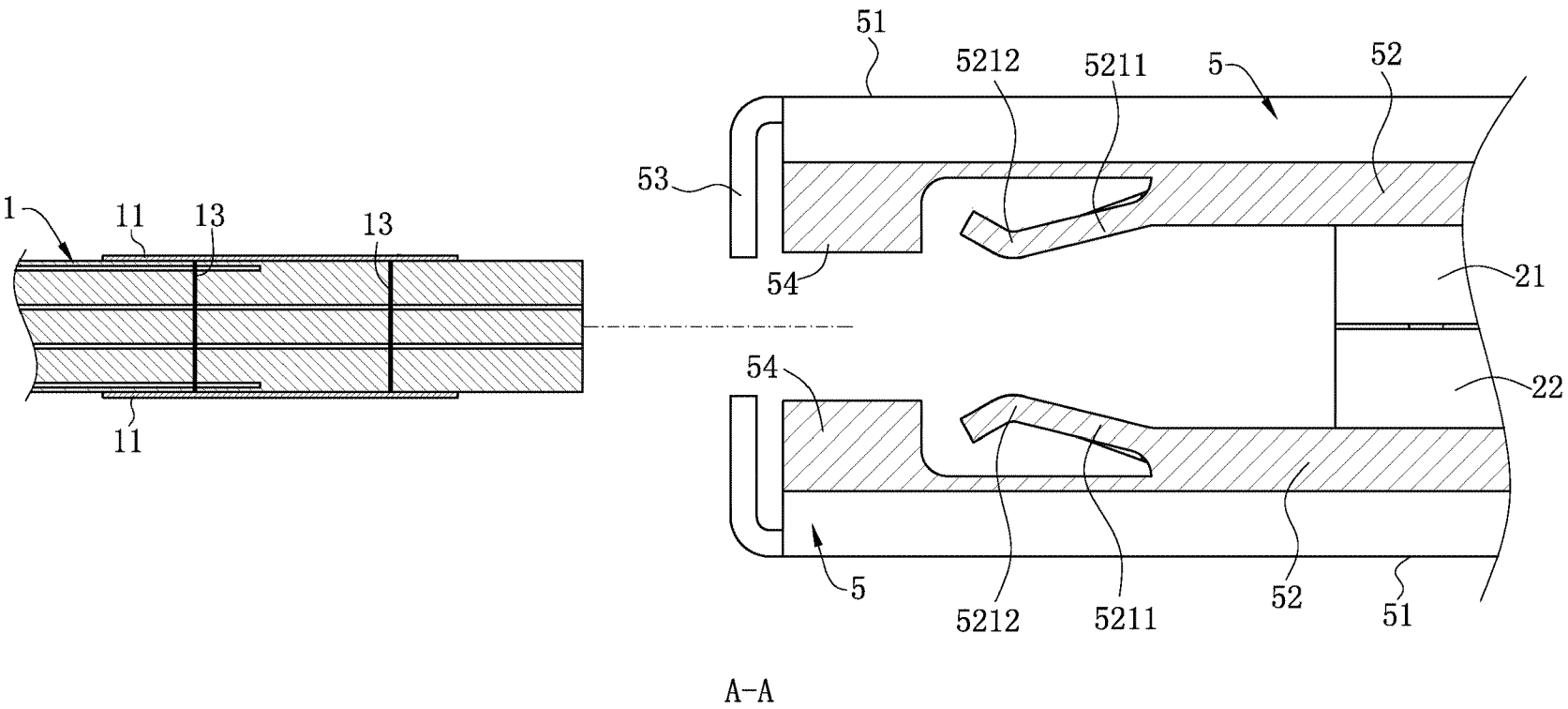
FIG. 5 is a sectional view at ground pads of a cable apparatus according to one embodiment of the present invention before plugging of a circuit board.
Figure 6:
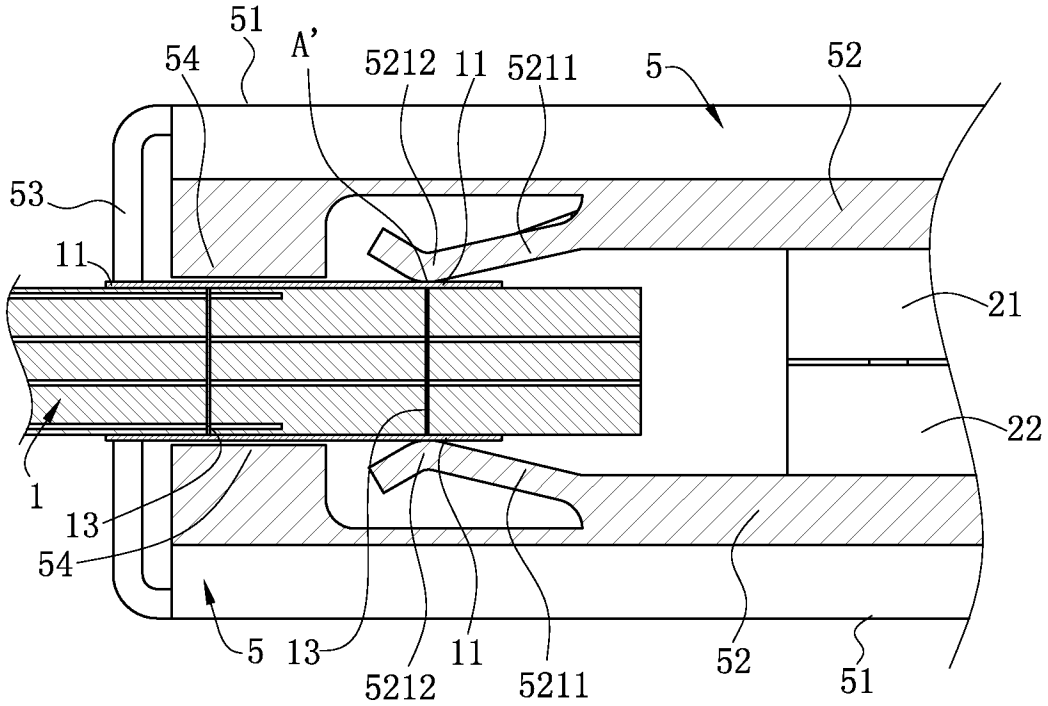
FIG. 6 is a sectional view along A-A after the plugging of a circuit board of a cable apparatus according to one embodiment of the present invention.

As shown in FIGS. 1, 5, and 6, four signal pads 12 and three ground pads 11 are separately provided on each of the upper surface and the lower surface of the circuit board 1. The four signal pads 12 on each surface of the circuit board 1 are divided into two groups, and each group includes two of the signal pads 12, and correspondingly conducts to one pair of the elastic portions 31 of each row. One of the ground pads 11 is provided on each of two outer sides of the four signal pads 12 and correspondingly conducts to different shrapnels 521. There is one of the ground pads 11 between the two groups of the signal pads 12, and that ground pad 11 conducts each of the two shrapnels 521 that are attached to each other. Each pair of the ground pads 11 symmetrically arranged on the upper and lower surfaces of the circuit board 1 have two conductive paths 13 conducted with each other, and the two conductive paths 13 are both located between two shielding shells 5 that vertically correspond to each other, so as to form an entire loop between the upper and lower shielding shells 5 and between the upper and lower ground pads 11, so that a shielding effect of the shielding shell 5 is optimal. Further, one of the two conductive paths 13 directly faces a point where the shrapnel 521 contacts the ground pad 11. Such a smart design enables the shield loop between the upper and lower shielding shells 5 and between the upper and lower ground pads 11 to be optimized.

As shown in FIGS. 1-4, in an assembling process of the cable apparatus 100 of this invention, first, the differential signal terminals 3 in the upper row and the differential signal terminals 3 in the lower row are respectively integrally formed on the first body 21 and the second body 22. Then the first body 21 and the second body 22 are buckled in a vertical direction to form the insulating body 2. Then the cable core 41 is correspondingly soldered to the contacting portion 32. The shielding shells 5 in the upper row and the shielding shells 5 in the lower row are covered, so that the side walls 52 are correspondingly accommodated in the first slots 23 and the second slot 24. A corresponding end of the shielding shell 5 is soldered to the shielding layer 43 by means of a solder paste 7. Finally, injection molding is performed on the upper and lower plastic blocks 6 to the insulating body 2, so that the shielding shell 5 is fixed to the insulating body 2. This embodiment of the invention is finished by inserting the circuit board 1 from back to front.

In this embodiment, the upper and lower surfaces of the circuit board 1 are respectively provided with two of the shielding shells 5, two pairs of the differential signal terminals 3, and two of the cables 4. In other embodiments, quantities of the pairs of the differential signal terminals 3, the shielding shells 5, and the cables 4 can be configured according to actual requirements, and this invention is not limited thereto.

In summary, the cable apparatus 100 according to certain embodiments of the present invention has the following beneficial advantages:

(1) One end of the shielding shell 5 is covered on the contacting portions 32 and conducts with the shielding layer 43, and the other opposite end is covered on the elastic portions 32 and is connected to the ground pad 11 to form entire shielding coverage from front to back of the differential signal terminals 3 and the cable cores 41, so as to ensure that an entire path of signal transmission has good electromagnetic shielding isolation, so that the cable apparatus 100 can be adjusted to transmission of signals with higher rates.

(2) The rear wall 53 and the shrapnel 521 urge against the shielding shell 5 at the same time to be grounded, so that multipoint grounding is formed for the shielding shell 5, and a crosstalk isolation effect is more stable.

(3) Two of the ground pads 11 symmetrically arranged on the upper and lower surfaces of the circuit board 1 have two conductive paths 13 conducted with each other, and the two conductive paths 13 are both located between two shielding shells 5 that vertically correspond to each other, so as to form an entire loop between the upper and lower shielding shells 5 and between the upper and lower ground pads 11, so that a shielding effect of the shielding shell 5 is optimal.

(4) One of the two conductive paths 13 directly faces a point where the shrapnel 521 contacts the ground pad 11. Such a smart design enables the shield loop between the upper and lower shielding shells 5 and between the upper and lower ground pads 11 to be optimized.

(5) The first contact location A and the second contact location B are arranged in one row, so as to ensure synchronism of stress applied to the circuit board 1 during plug connection, thereby extending service life of the cable apparatus 100.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A cable apparatus, comprising:

a circuit board provided with a plurality of ground pads and signal pads, wherein one of the ground pads is provided on each of two sides of adjacent two of the signal pads;

an insulating body located in front of the circuit board;

at least one pair of differential signal terminals retained in the insulating body, wherein one end of each terminal of the at least one pair of differential signal terminals is provided with an elastic portion that extends out of the insulating body and conducts with one of the signal pads, and the other end of each terminal of the at least one pair of differential signal terminals is provided with a contacting portion exposed on a surface of the insulating body;

a cable located in front of the insulating body, wherein the cable comprises two cable cores each being connected to corresponding one of the contacting portions, two insulation layers respectively wrapping the two cable cores, and one shielding layer wrapping the two insulation layers; and at least one shielding shell fixed to the insulating body, wherein one end of the at least one shielding shell is covered on the contacting portions and conducts with the shielding layer, and the other end of the at least one shielding shell is covered on the elastic portions and is connected to one of the ground pads.

2. The cable apparatus of claim 1, wherein only two of the signal pads are provided between any adjacent two of the ground pads on a same surface of the circuit board.

3. The cable apparatus of claim 1, wherein the at least one shielding shell has a top wall and two side walls bending and extending from opposite two sides of the top wall;

wherein one end of the top wall is soldered to the shielding layer, and an edge of the other end bends and extends to form a rear wall; and wherein the rear wall is conductively connected to the one of the ground pads, and an edge of each of the side walls extends to form a shrapnel to urge against the one of the ground pads.

4. The cable apparatus of claim 3, wherein a location where the shrapnel urges against the one of the ground pads is a first contact location, a location where the elastic portion urges against the one of the signal pads is a second contacting portion, and the first contact location and the second contact location are arranged in a row.

5. The cable apparatus of claim 3, wherein the shrapnel comprises a connecting portion formed by extending backward from the side wall toward the circuit board, and a guiding portion formed by further extending toward a direction away from the circuit board, the guiding portion urges against the one of the ground pads, and there is a gap between the guiding portion and the side wall.

6. The cable apparatus of claim 5, wherein an included angle between the guiding portion and the connecting portion is an obtuse angle to make the shrapnel have a shape of a hook.

7. The cable apparatus of claim 3, wherein the opposite two sides of the top wall further bend and extend to form two extending portions, each of the extending portions is located between the rear wall and corresponding one of the side walls, an edge of each of the extending portions is closer to the circuit board than the edge of corresponding one of the side walls, and does not contact the circuit board.

8. The cable apparatus of claim 7, wherein the extending portions are not connected to the rear wall.

9. The cable apparatus of claim 1, wherein the shielding layer is a copper foil, and the shielding layer longitudinally wraps the two insulation layers at the same time along a direction parallel to an axis of the cable core.

10. The cable apparatus of claim 1, wherein each of the ground pads is located on an upper surface or a lower surface of the circuit board, the at least one shielding shell comprises a plurality of shielding shells, each of the ground pads is connected to one of the shielding shells; and two of the ground pads aligned in a vertical direction are connected through at least two conductive paths, and the two conductive paths are located between two of the shielding shells.

11. The cable apparatus of claim 10, wherein at least one of the two conductive paths directly faces a location where corresponding one of the shielding shells contacts the ground pad.

12. The cable apparatus of claim 10, wherein each of the shielding shells has two side walls, an edge of each of the side walls tears and extends to form a shrapnel to urge against corresponding one of the ground pads, one of the conductive paths directly faces a location where the shrapnel contacts the corresponding one of the ground pads.

13. The cable apparatus of claim 1, wherein the insulating body comprises a first body and a second body buckled with the first body;

wherein the at least one pair of differential signal terminals comprises an upper row and a lower row of differential signal terminals that are symmetrically arranged, the upper row and the lower row of the differential signal terminals are respectively integrally formed on the first body and the second body; and wherein the differential signal terminals in the upper row have the contacting portions exposed on a surface of the first body and soldered to the cable cores, and the differential signal terminals in the lower row have the contacting portions exposed on a surface of the second body and soldered to the cable cores.

14. The cable apparatus of claim 13, further comprising two plastic blocks respectively covered on the contacting portions of the upper row of the differential signal terminals and the contacting portions of the lower row of the differential signal terminals, wherein the two plastic blocks are integrally formed with the insulating body and the shielding shell.

15. The cable apparatus of claim 1, wherein the shielding shell is connected to the shielding layer by soldering.

16. The cable apparatus of claim 1, wherein two adjacent shielding shells and two pairs of the differential signal terminals are provided on a same surface of the circuit board, each of the shielding shells is correspondingly covered on one pair of the differential signal terminals, and adjacent side walls of the two shielding shells are attached to each other and are connected to a same one of the ground pads.

17. The cable apparatus of claim 16, wherein two first slots and a second slot located between the two first slots are provided on the surface of the insulating body, a width of the second slot is greater than that of the first slots, each of the first slots correspondingly accommodates one side wall of corresponding one of the shielding shells, and the second slot accommodates two side walls that are attached to each other of the two adjacent shielding shells.

* * * * *